US011060420B2

(12) United States Patent
Reghezza et al.

(10) Patent No.: US 11,060,420 B2
(45) Date of Patent: Jul. 13, 2021

(54) EXTRACTION DEVICE OF A PLATFORM FOR HOLDING A BLADE AND METHOD USING THIS DEVICE

(71) Applicant: SAFRAN AIRCRAFT ENGINES, Paris (FR)

(72) Inventors: Patrick Jean-Louis Reghezza, Moissy-Cramayel (FR); Pierrick Charles Chevallier, Moissy-Cramayel (FR); Simon Pierre Claude Charbonnier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 174 days.

(21) Appl. No.: 16/191,191

(22) Filed: Nov. 14, 2018

(65) Prior Publication Data

US 2019/0145283 A1 May 16, 2019

(30) Foreign Application Priority Data

Nov. 15, 2017 (FR) ..... 1760751

(51) Int. Cl.
*F01D 25/28* (2006.01)
*B25B 27/02* (2006.01)
*B25B 27/06* (2006.01)

(52) U.S. Cl.
CPC ..... *F01D 25/285* (2013.01); *B25B 27/02* (2013.01); *B25B 27/062* (2013.01); *F05D 2230/70* (2013.01)

(58) Field of Classification Search
CPC ..... F01D 25/285; B25B 27/062; B25B 27/02; B25B 27/18; F05D 2230/70; B66F 15/00
See application file for complete search history.

(56) References Cited

U.S. PATENT DOCUMENTS 6,260,442 B1 * 7/2001 Bayat ..... H01J 9/003 81/441
2012/0131778 A1 5/2012 Ferreira et al.
2012/0144643 A1 6/2012 Saito et al.

FOREIGN PATENT DOCUMENTS

FR 2948592 A1 2/2011
WO WO-9626042 A1 * 8/1996 ..... B25B 27/062
(Continued)

OTHER PUBLICATIONS

Preliminary Research Report received for French Application No. 1760751, dated Jul. 30, 2018, 3 pages (1 page of French Translation Cover Sheet and 2 pages of original document).

*Primary Examiner* — Sarang Afzali
(74) *Attorney, Agent, or Firm* — Womble Bond Dickinson (US) LLP

(57) ABSTRACT

An extraction device of a platform for holding a blade fitted with an upstream flange, out of a turbomachine rotor disc, and extraction method using the device. The device includes a handle fitted with a radial annular shoulder extended by a threaded pin, a proximal ring and a distal ring having a tube extended by a radial collar and a sleeve. The proximal ring is arranged around the pin, the tapped distal ring being screwed onto the other end of the pin and the sleeve being arranged around the two rings between their respective collars. Screwing of the handle results in moving the distal ring towards the proximal ring, radial deformation of the distal part of the sleeve against the flared part of the cylindrical orifice of the flange and its being joined to the latter. It is possible to conjointly extract the platform and the device from the disc.

9 Claims, 4 Drawing Sheets

(56) References Cited

FOREIGN PATENT DOCUMENTS

| | | | |
|---|---|---|---|
| WO | 2013/180928 | A1 | 12/2013 |
| WO | 2016/060906 | A1 | 4/2016 |

* cited by examiner

EXTRACTION DEVICE OF A PLATFORM FOR HOLDING A BLADE AND METHOD USING THIS DEVICE

GENERAL TECHNICAL FIELD

The invention relates to the field of maintenance and disassembly of specific parts of a turbomachine rotor.

The present invention relates more precisely to an extraction device of a platform for holding a blade, out of a turbomachine rotor disc and an extraction method using such a device.

PRIOR ART

Figure 1:
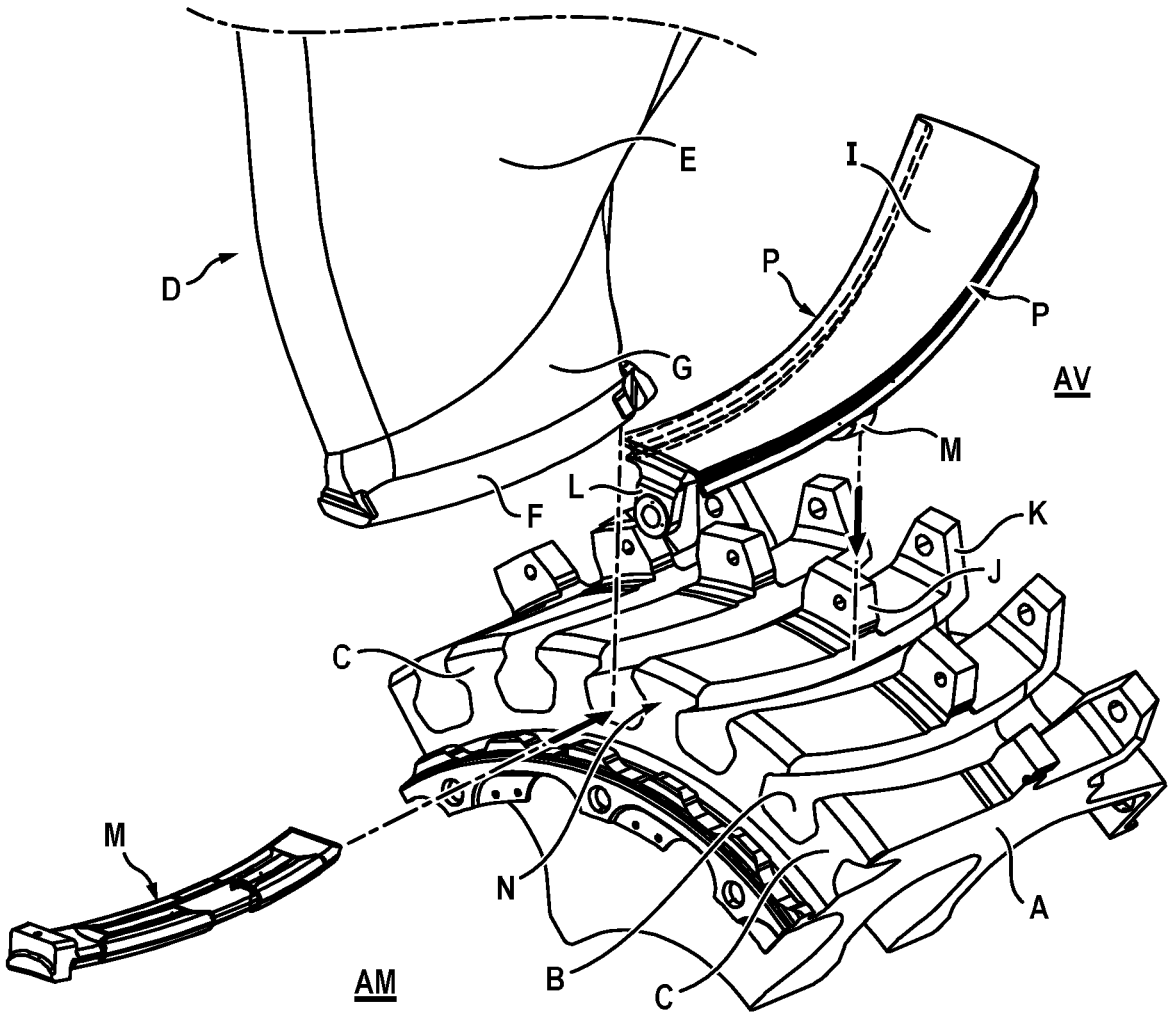

FIG. 1 attached shows part of such a rotor disc.

This figure shows part of a rim of a rotor disc A, in which grooves B oriented axially are arranged, that is, parallel to the axis of rotation of the rotor. Each groove B has a transversal cross-section in the form of a dovetail and is rimmed by two axial teeth C. These teeth C are spaced apart circumferentially from each other.

There is also a blade D shown, which comprises a vane E, a foot F and a stilt G connecting the vane to the foot. The foot F has a cross-section in the form of a dovetail whereof the height is slightly less than that of the groove B. The foot F of the blade is engaged by axial sliding in said groove B.

An axial wedge H is also inserted into said groove B, under the foot F of the blade, to wedge this blade radially.

Finally, there is a platform I intended to cap each tooth C and be fixed to two respective perforated projections J and K of this tooth, these projections J and K extending one downstream of the other (relative to the direction of flow of air across the blades of the rotor) and radially from the external surface of the tooth C.

Each platform I is curved from upstream AM to downstream AV. Each platform I also comprises an upstream flange L and two downstream flanges M, these two flanges M being arranged one downstream of the other (a single downstream flange is evident in FIG. 1). When the platform I is in place, the upstream flange L is positioned in front of the vertical upstream end N of the tooth C and the two downstream flanges M in front of the respective projections J and K.

Assembling the flanges of the platform I with the upstream end N and the projections J and K of the tooth is done by screws, not shown in FIG. 1.

The two curved lateral edges P of each platform I make contact with the stilts G of the two blades D located on either side of said platform. The platform I serves to improve the aerodynamic flow between the blades D and ensures the continuity of the primary vein.

During maintenance operations on the rotor, performed while the turbomachine has been disassembled or else under the wing of the aircraft, it is necessary to disassemble the blade platforms.

Now, non-adapted disassembly can cause unacceptable damages to the platform or surrounding parts.

Document FR 2 948 592 already discloses tools for extracting annular elements, (such as rings), mounted clamped in holes of parts.

These tools having a fairly complex structure comprise many parts specifically a tie rod with enlarged head, an annular cage with elastically deformable lateral grips, a tightening nut, a ball stop, a cylindrical tube for insertion of the cage in the axial passage of the ring and finally a cylindrical dome intended to be arranged around the tie rod.

Apart from their complex structure and its many parts, these tools need to be disassembled so that their different parts are inserted successively into the annular element to be extracted.

PRESENTATION OF THE INVENTION

The aim of the invention therefore is to resolve the above disadvantages of the prior art and provide an extraction device of a platform for holding a blade, which undertake this extraction without damaging either the platform or the disc.

Another aim of the invention is to propose a device which simply and quickly removes the platforms while being adapted to an environment lacking accessibility.

For this purpose the invention relates to an extraction device of a platform for holding a blade, out of a turbomachine rotor disc, said platform being fitted with an upstream flange having an orifice whereof the downstream part is flared.

According to the invention, this device comprises:

a handle having an opposite handling end and an engagement end, the engagement end being fitted with a radial annular shoulder which is extended by a threaded axial pin, a so-called "proximal" ring and a so-called "distal" ring which each comprise a tube extended at one of its both ends by a radial collar which extends towards the exterior of said tube, and a sleeve, the proximal ring, whereof the inner tubular wall is smooth, being arranged around the proximal end of the pin, so that the collar of the proximal ring is against the annular shoulder of the manipulation handle, the distal ring, whereof the inner tubular wall is tapped being screwed around the distal end of the pin and arranged so that the collar of the distal ring is opposite the distal end of the pin, the sleeve being arranged around the two tubes of the two rings so that its two ends bear respectively against one and other of the two collars, such that screwing of the handle causes axial displacement of the distal ring in the direction of the proximal ring and causes compression of the sleeve and radial deformation of the distal part of the sleeve until the latter makes contact with the flared part of the inner wall of the orifice of the flange, joining together said extraction device and the platform to be extracted and allowing their joint extraction from the turbomachine rotor disc.

Because of these characteristics, the device according to the invention easily removes the platform, by simple screwing manipulation and without damaging the latter.

The invention also relates to an extraction method of a platform for holding a blade, out of a turbomachine rotor disc, said platform being fitted with an upstream flange whereof the downstream part of the cylindrical orifice is flared.

According to the invention, this method comprises the steps consisting of:

inserting the above device into the orifice of the upstream flange until the radial shoulder of the handle is in axial stop against this flange, screwing the handle so as to move the distal ring to the proximal ring and cause compression of the sleeve and radial deformation of its distal part until the latter makes contact with the flared part of the inner wall of the orifice of the flange, joining together said extraction device and the platform to be extracted, simultaneously removing said extraction device and said holding platform from the rotor disc of the turbomachine.

PRESENTATION OF FIGURES

Other characteristics and advantages of the invention will emerge from the description which will now be given in reference to the appended drawings which illustrate one possible embodiment by way of indication but non-limiting.

Figure 2:
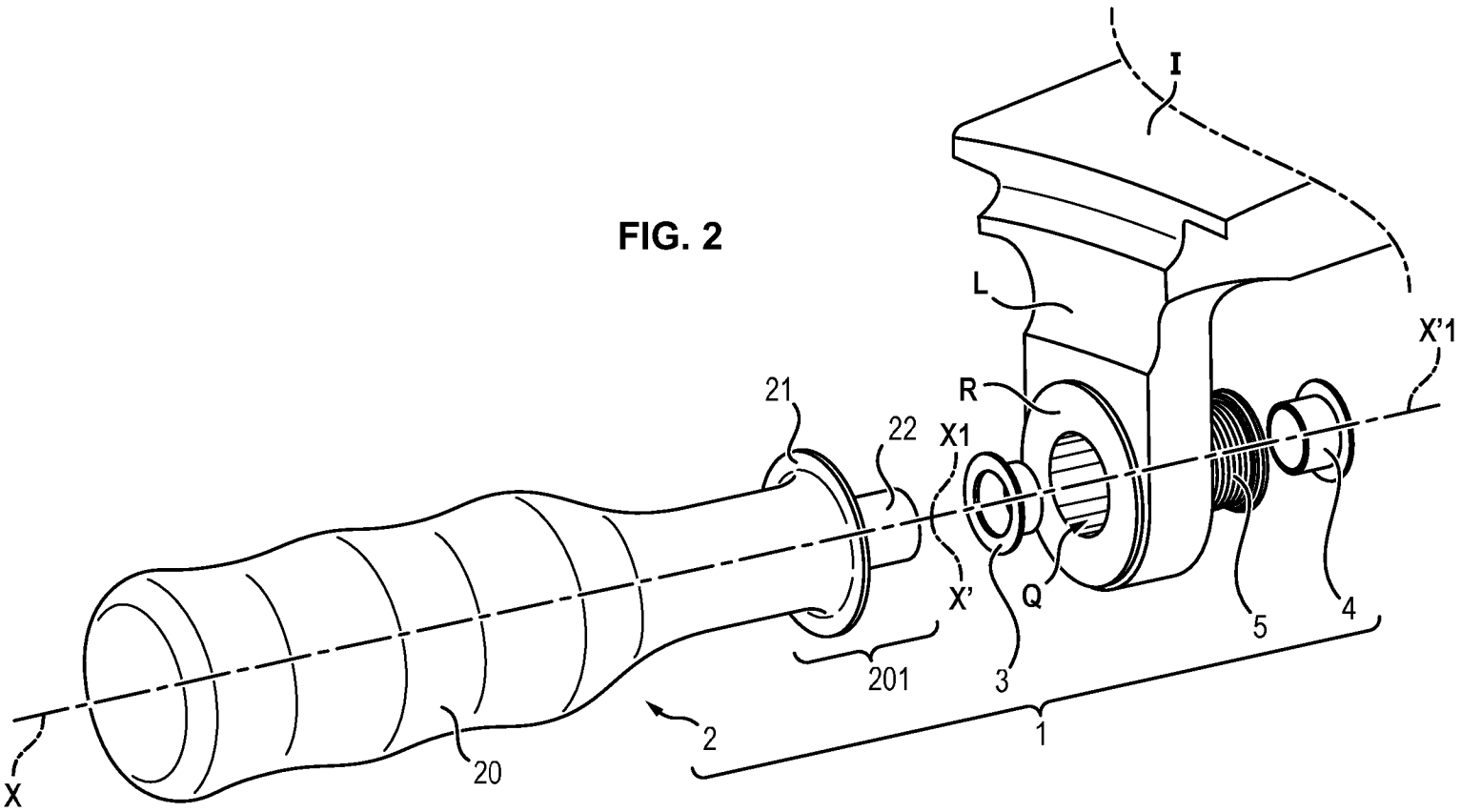
Figure 3:
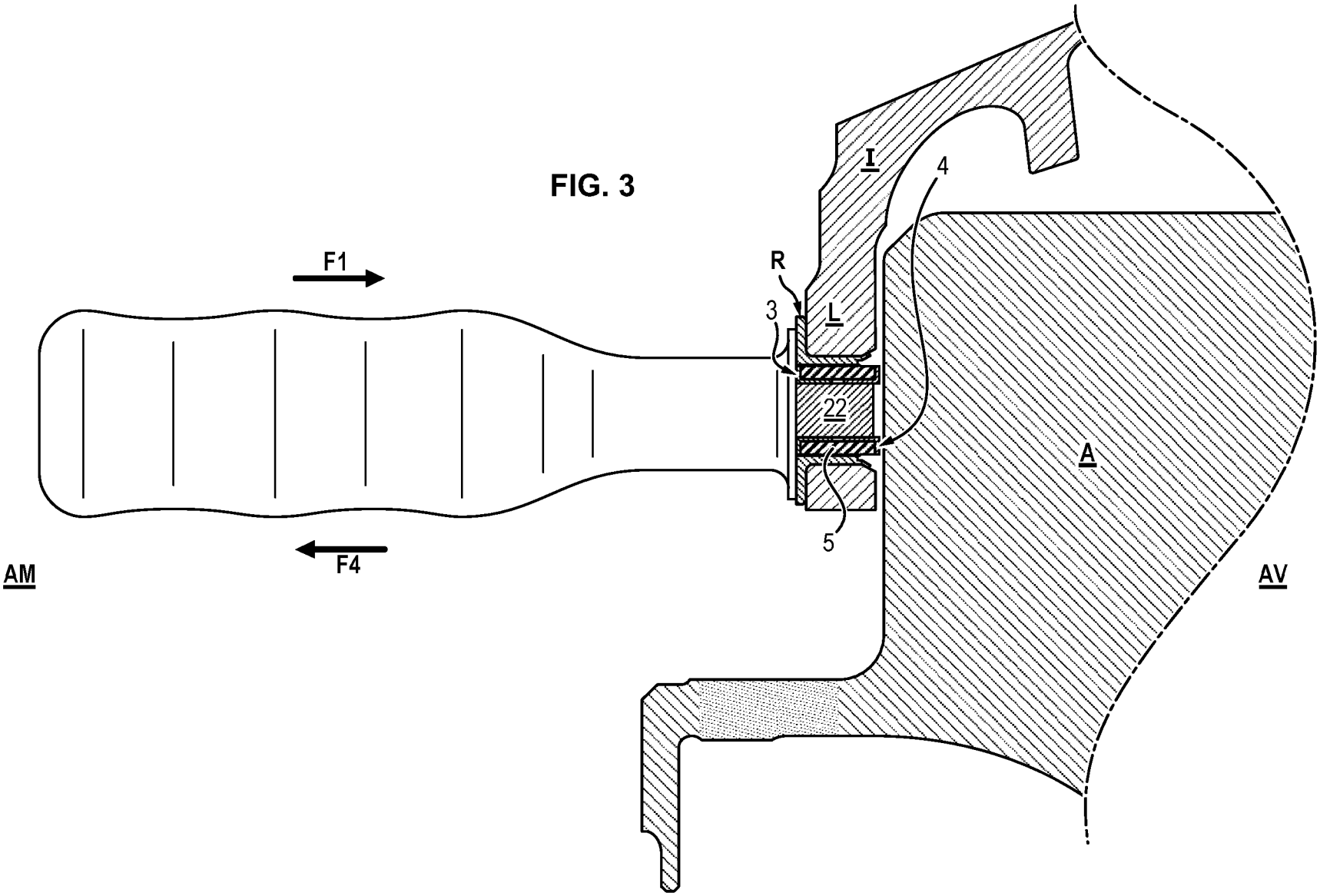
Figure 4:
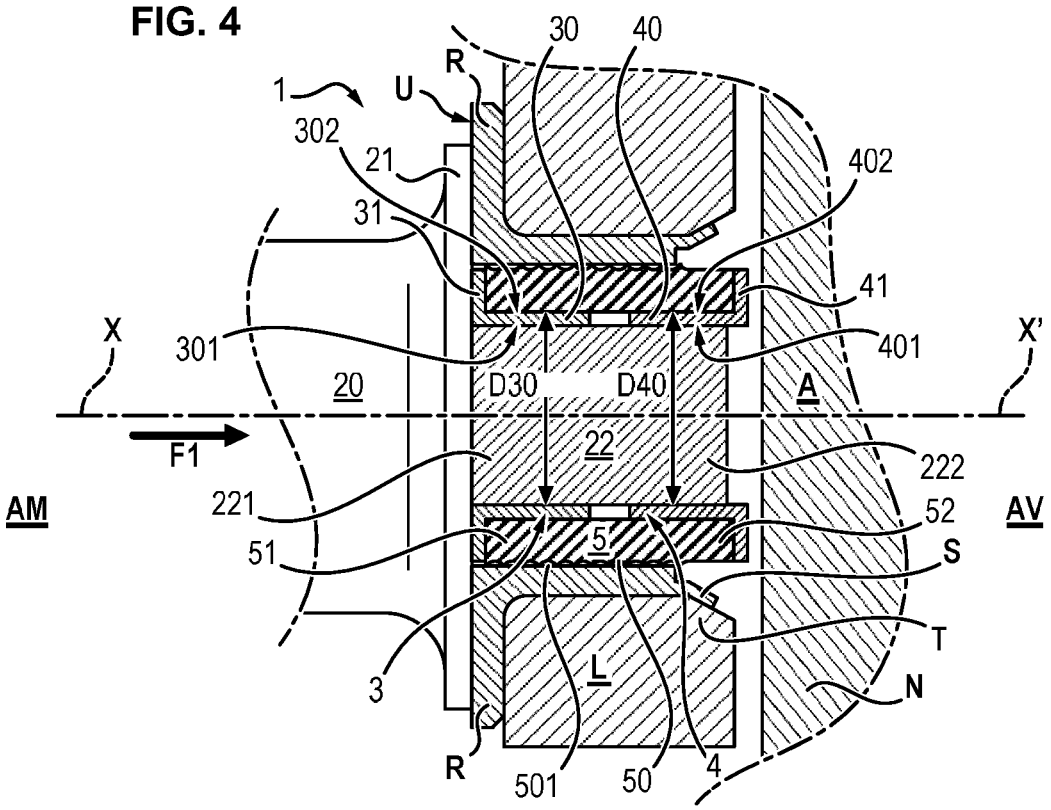
Figure 5:
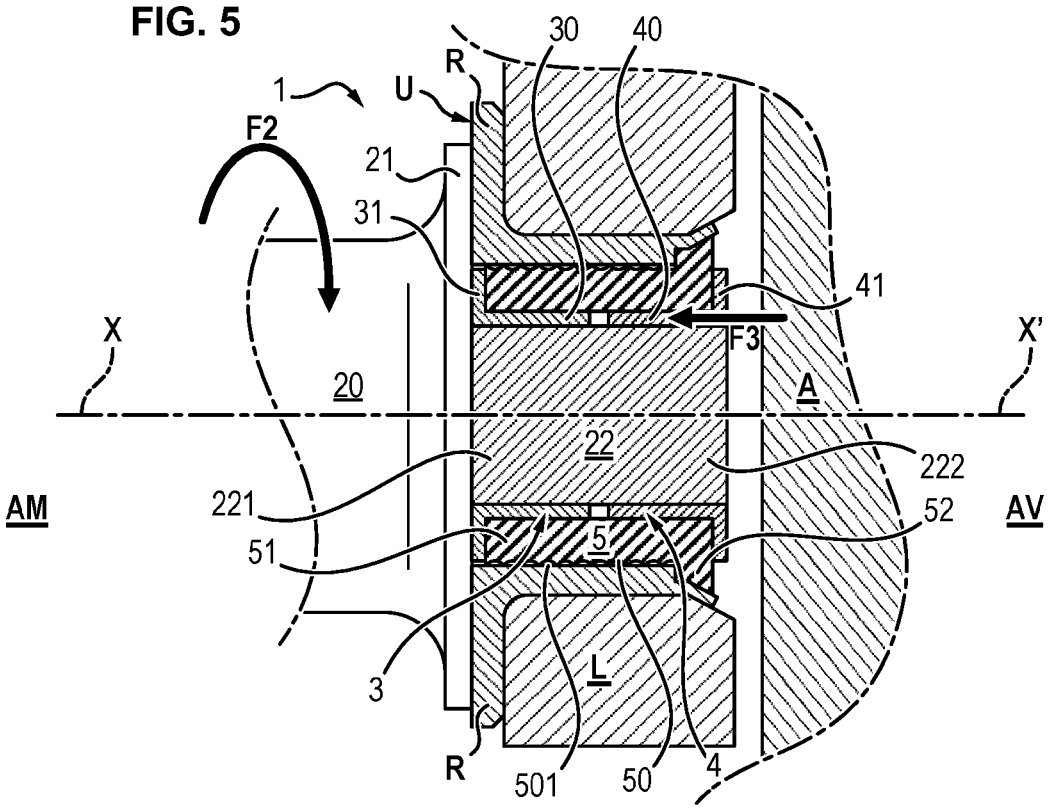

In these drawings:

FIG. 1 is an exploded view in perspective of the base of a blade, a platform and a part of a rotor disc, FIG. 2 is an exploded view in perspective of the extraction device according to the invention, FIG. 3 is a sectional view of the extraction device positioned inside the platform for holding a blade to be extracted, FIGS. 4 and 5 are sectional and detailed views of the end of the extraction device placed inside the upstream flange of said platform, respectively in the engagement position of said device and in its extraction position.

DETAILED DESCRIPTION

In reference to FIG. 2, this shows the upstream flange L of the platform I. This flange is pierced by an orifice Q, inside which a tubular socket R is generally placed. The orifice Q exhibits a longitudinal axis X1-X'1.

As is evident in FIGS. 4 and 5, the downstream annular end S of the socket R is flared towards the outside as is the downstream part T of the inner wall of the cylindrical orifice Q of the flange L against which it bears.

The extraction device 1 according to the invention comprises a handle 2, two rings, specifically a so-called "proximal" ring 3, and a so-called "distal" ring 4, as a function of their position more or less near the handle 2 and a sleeve 5.

The handle 2 comprises a handling end 20 (or stick) and an engagement end 201 which are opposed. The engagement end 201 is fitted with a radial annular shoulder 21 which is extended by a cylindrical axial pin 22, threaded on its external surface, (see also the FIG. 4). The diameter of the pin 22 is less than that of the radial shoulder 21.

The proximal end of the pin 22 (located most closely to the shoulder 21) is referenced 221 and its distal end 222.

The handle 2 extends according to a longitudinal axis X-X'.

The two rings 3 and 4 comprise each a tube 30, respectively 40, which is extended at one of its ends by a radial annular collar 31, respectively 41, (see FIG. 4). This collar plays a role of axial holding of the sleeve 5 as will be described later.

The inner wall 301 of the tube 30 of the proximal ring 3 is smooth. Preferably, its external wall 302 is also.

The inner wall 401 of the tube 40 of the distal ring 4 is tapped, this tapping corresponding and cooperating (that is, meshing) with the threading of the pin 22. The external wall 402 of the tube 40 of the distal ring 4 is preferably smooth.

The internal diameter of the tube 30 of the proximal ring 3 is larger (slightly more) than the external diameter of the cylindrical pin 22 so as to allow introduction of said pin into this tube and its rotation around the axis X-X'.

The proximal ring 3 is oriented so that its collar 31 is near the shoulder 21.

The distal ring 4 is screwed around the distal end 222 of the pin 22 so that its collar 41 is near this distal end, (end opposite to that where the shoulder 21 is).

Finally, the sleeve 5 is arranged around the tubes 30 and 40 of the rings 3 and 4 and it is dimensioned in terms of internal diameter and length, so that it bears against the external walls 302, 402 of the rings, its two proximal 51 and distal 52 ends are respectively in contact with the collars 31, 41 and its distal end is opposite the flared downstream part of the cylindrical orifice Q.

Preferably, the respective external diameters D30 and D40 of the tubes 30 and 40 are identical so as to allow easy insertion of the sleeve 5 around said tubes.

The two rings 3 and 4 and the sleeve 5 are annular parts whereof the axis of revolution is combined with the axis X-X' of the handle 2, when they are mounted on the latter.

The sleeve 5 is a tubular element, preferably made of elastically deformable material so that it can return to its original position after deformation, as will be explained later. This material is preferably elastomer.

Preferably also, this sleeve 5 is made of material whereof the Shore hardness A is adapted to the material constituting the upstream flange L of the platform I or to the material of the tubular socket R when the latter is present. The Shore hardness A is for example between 30 Shore and 80 Shore, especially when the flange is made of aluminium or the socket is made of steel.

The sleeve 5 plays a role of anti-rotation sleeve, that is, it prevents rotation of the distal ring 4 relative to the proximal ring 3, and does this by rubbing its internal surface against the external walls 302, 405 of the rings 3 respectively 4.

By way of advantage, the external diameter of the sleeve 5 in the non-compressed state corresponds, close to the introduction clearance, to the internal diameter of the orifice Q of the upstream flange of the platform to be extracted, such that when the device 1 is introduced into the orifice Q, the sleeve 5 rubs against the inner wall of this orifice, can no longer turn and reinforces the bond between the device 1 and the platform during extraction.

By way of advantage, the external surface 50 of the sleeve 5 exhibits preferably over at least part of its length a plurality of annular throats 501, preferably parallel to each other, arranged around the longitudinal axis of the sleeve, that is, perpendicular to the axis of said sleeve. As will be describes later, this geometry favours holding the device during extraction and distributes the traction force to prevent it being applied in the region of the flared part only.

The sleeve preferably comprises between five and twenty throats 501.

It is clear that the anti-rotation geometry zone does not need to extend in the region of the end downstream of the sleeve 5 located opposite the flared end S of the socket when the device 1 is inserted into the socket.

The use and operation of the extraction device 1 will now be explained in more detail.

The operator commences by removing the screws by which the platform L is fixed onto the rim of the rotor disc A.

Next, as shown in FIGS. 3 and 4, it inserts the device 1 into the orifice Q by translation, the axis X-X' of the device 1 being coaxial to the axis X1-X1 of the orifice Q (arrow F1) until the shoulder 21 makes contact with the upstream face U of the tubular socket R.

The operator next screws the device 1 by turning the handle 2 (arrow F2 in FIG. 5). Since the handle 2 is blocked axially by the socket R, the proximal ring 3 does not move, whereas the distal ring 4 moves to the ring 3 (axial translation movement, arrow F3). This results in the sleeve 5 being compressed and deforming radially. Its rear part especially moves away radially to come up against the flared downstream annular end S of the socket R, (see FIG. 5).

Next, via axial traction in the reverse direction of the direction of introduction (arrow F4 in FIG. 3), the operator can simultaneously remove the device 1 and the platform I since the distal end of the compressed sleeve 5, pressed against the flared end of the flange, shifts the flange L axially.

When next the handle 2 is unscrewed, the distal ring 4 retracts and returns to its original position. The sleeve 5 is no longer compressed and due to its preferably elastically deformable character returns to its original position.

The extraction device 1 can be removed from said platform and be reused to disassemble another platform and this can be repeated.

The extraction device 1 according to the invention has many advantages.

Due to its easy handling, it simply and quickly removes the platforms for holding blades installed on the engines, which is also advantageous when there are many platforms to be removed.

This device offers a considerable time gain during removal of the platforms.

Due especially to its small dimensions and its portable character, it can be used in the workshop (disassembled engine) or under the wing of the aircraft (engine in place, for example during relubrication operations of the feet of blades), that is, in an environment lacking accessibility.

Finally, this extraction device does not damage the platforms or the rotor discs.

The invention claimed is:

1. An extraction device of a platform for holding a blade, out of a turbomachine rotor disc, said platform being fitted with an upstream flange having an orifice including an inner wall with a flared part, wherein the extraction device comprises:

a manipulation handle having an opposite handling end and an engagement end, the engagement end being fitted with a radial annular shoulder which is extended by a threaded axial pin, a proximal ring and a distal ring, which each comprise a tube extended at one of both ends of the tube by a radial collar which extends towards an exterior of said tube, and a sleeve of tubular shape and having a cylindrical interior with distal and proximal ends, the proximal ring, whereof an inner tubular wall is smooth, being arranged around a proximal end of the pin, so that the collar of the proximal ring is against the annular shoulder of the manipulation handle, the distal ring, whereof an inner tubular wall is threaded, being threadingly engaged around a distal end of the threaded axial pin and arranged so that the collar of the distal ring is opposite the distal end of the pin, the tube of the proximal ring and the tube of the distal ring being inserted into the interior of the sleeve to make the tube of the proximal ring and the tube of the distal ring all coaxially assembled to each other, so that a distal end of the sleeve bears against the radial collar of the distal ring and a proximal end of the sleeve bears against the radial collar of the proximal ring, such that the turning of the handle causes threaded engagement of the handle pin and the inner tubular wall of the distal ring which causes axial displacement of the distal ring in the direction of the proximal ring and causes compression of the sleeve and radial deformation of the distal end of the sleeve until the distal end of the sleeve makes contact with the flared part of the inner wall of the orifice of the flange, joining together said extraction device and the platform to be extracted and allowing a joint extraction of the extraction device and of the platform from the turbomachine rotor disc.

2. The extraction device according to claim 1, wherein the sleeve is made of elastically deformable material.

3. The extraction device according to claim 2, wherein the sleeve is made of elastomer.

4. The extraction device according to claim 1, wherein the external surface of the sleeve comprises a plurality of annular throats, arranged around the axis of said sleeve.

5. The extraction device according to claim 4, wherein said sleeve comprises between five and twenty annular throats.

6. The extraction device according to claim 1, wherein the sleeve is an anti-rotation sleeve which prevents rotation of the distal ring relative to the proximal ring.

7. The extraction device according to claim 1, wherein the sleeve is made of material having a Shore hardness A between 30 Shore and 80 Shore.

8. The extraction device according to claim 1, wherein the external diameter of said sleeve in the noncompressed state corresponds, close to the introduction clearance, to the internal diameter of the orifice of said upstream flange of the platform to be extracted.

9. An extraction method of a platform for holding a blade, out of a turbomachine rotor disc, said platform being fitted with an upstream flange having an orifice including an inner wall with a flared part, wherein the extraction method comprises:

inserting the extraction device according to claim 1 into the orifice of the upstream flange until the radial shoulder of the handle is in axial stop against said upstream flange, screwing the handle so as to move the distal ring to the proximal ring and cause compression of the sleeve and radial deformation of a distal part of the sleeve until the distal part of the sleeve makes contact with the flared part of the inner wall of the orifice of the flange, joining together said extraction device and the platform to be extracted, and simultaneously removing said extraction device and said holding platform from the rotor disc of the turbomachine.

* * * * *